United States Patent [19]

Lam et al.

[11] 4,287,513

[45] Sep. 1, 1981

[54] DOOR KNOB ALARM DEVICE

[75] Inventors: Hau C. Lam; Thomas K. P. Lee; Y. C. Cheng, all of Kowloon, Hong Kong

[73] Assignee: International Quartz Ltd., Kowloon, Hong Kong

[21] Appl. No.: 35,721

[22] Filed: May 3, 1979

[51] Int. Cl.[3] ..... G08B 13/22

[52] U.S. Cl. ..... 340/562; 307/125

[58] Field of Search ..... 340/562, 546; 307/125

[56] References Cited

U.S. PATENT DOCUMENTS

| | | | |
|---|---|---|---|
| 3,200,306 | 8/1965 | Atkins et al. | 340/562 |
| 3,697,971 | 10/1972 | Domin et al. | 340/562 |
| 4,091,371 | 5/1978 | Mason, Jr. et al. | 340/562 |
| 4,145,748 | 3/1979 | Eichelberger et al. | 307/125 |
| 4,168,495 | 9/1979 | Sweeney | 340/546 |
| 4,173,755 | 11/1979 | Butler | 340/562 |
| 4,176,348 | 11/1979 | Tobin et al. | 340/562 |

*Primary Examiner*—Glen R. Swann, III

*Attorney, Agent, or Firm*—Thomas R. Vigil

[57] ABSTRACT

The alarm device includes a resilient metallic spring strap which is received over a doorknob and against the shank of the doorknob and which forms an input contact to the device. The device further includes an oscillator which outputs a signal through a coupling network having a capacitive branch to ground that includes a capacitive path extending through the strap to the doorknob. When a person touches the doorknob, a capacitive path to ground is established that causes increased attenuation of the signal level. A self-initializing and self-compensating amplifier in the device detects such drops in the signal level and triggers a pulsating alarm. The circuit needs no manual adjustment.

19 Claims, 3 Drawing Figures

DOOR KNOB ALARM DEVICE

BACKGROUND OF THE INVENTION

1. Field of the Invention

The invention relates generally to security devices and more particularly to devices that respond to the capacitance of the human body to give off an alarm when a human approaches a door or grips the doorknob thereof.

2. Description of the Prior Art

Devices of this type are fairly well known. For example, an alarm system that may be hung from a doorknob is disclosed in U.S. Pat. No. 3,623,063. The compact device disclosed therein contains an oscillator whose frequency is altered when someone's hand comes in contact with the doorknob. A tuned circuit remote from the oscillator is used as a filter. When the frequency of the oscillator changes in response to the presence of the hand, the amount of signal passing through the filter is altered (since the filter is frequency sensitive), and this alteration in signal level triggers an alarm mechanism.

Devices of the type disclosed in this patent are satisfactory for use as door alarms, but they must be equipped with some form of sensitivity control or adjustment that must be set manually to compensate for physical characteristics of the door, the temperature, variable components in the circuit and other such parameters. Accordingly, it can be difficult for one who is not technically inclined to use such a device.

Another form of door alarm is disclosed in U.S. Pat. Nos. 3,465,325, 3,648,076 and 4,011,554. These patents all disclose devices that sense 60 cycle signals flowing from the hand of one who grasps a doorknob or other apparatus. Like the device disclosed in U.S. Pat. No. 3,623,063, these 60 cycle sensing devices also require the use of sensitivity controls, as is apparent in U.S. Pat. Nos. 3,465,325 and 4,011,554.

The device disclosed in U.S. Pat. No. 3,648,076 has no sensitivity control, but it may only be installed with one side of its circuit connected to the AC line away from ground. Accordingly, it does not lend itself to easy installation. Such AC powered circuits are also not as portable as a device powered by a battery.

A third type of device is disclosed in U.S. Pat. No. 3,508,239. This device utilizes an oscillator and a tuned circuit, but once again the circuit parameters are critical because of the use of the tuned circuit elements and must be set up with precision if they are to function properly.

A more flexible device is disclosed in U.S. Pat. No. 3,973,208. That patent discloses a very sensitive system in which the transmission of a signal from an oscillator to a receptive amplifier is balanced out in a bridge-like manner. The capacitance of a human hand throws off the delicate balance and creates error signals that are detected by detector amplifiers. However, the circuitry utilized in this device is extremely complex as is apparent from the use therein of four (4) high gain operational amplifiers and a number of transistors used in a complicated circuit arrangement. In spite of its complexity, this circuit requires both a null adjustment and a sensitivity adjustment, and these controls may be difficult for those not mechanically inclined to use such controls.

As will be described in greater detail hereinafter, the doorknob alarm device of the present invention differs from the previously proposed devices by providing an alarm device which may be hung from a doorknob or otherwise used in connection with some metallic device and which does not require initializing or compensating adjustment whatsoever. Also, such alarm device contains no critical circuit parameters within it that can come out of adjustment as the device ages or as the ambient temperature changes. Such a simple alarm device may be used by someone having little or no mechanical skill, and still provides a device which is highly sensitive and does not require any adjustment.

Moreover, the alarm device of the present invention is compact and battery powered, and gives a quick and sure response to the presence of an intruder that is signalled by the hand of the intruder touching a doorknob.

SUMMARY OF THE INVENTION

According to the invention there is provided a doorknob alarm device comprising a body, means for hanging said device from a doorknob, electronic circuit means within said body including an oscillator circuit, a capacitance network coupled to the output of said oscillator circuit, an amplifier circuit coupled to the output of said capacitance network, means for electrically coupling said capacitance network to the doorknob so as to form an input to said electronic circuit means, self-initializing and self-compensating, oscillatory signal level detecting circuit means without manual sensitivity adjustment coupled to the output of said amplifier for detecting drops in the signal level from said amplifier such as would be caused by the addition of capacitance to said capacitance network when someone's hand comes close to or touches the doorknob on which said device is hung, an alarm circuit coupled to the output of said signal level detecting circuit, said alarm circuit being triggered by said signal level detecting circuit, and a regulated D.C. power supply for supplying voltage to said electronic circuit means.

Further according to the invention there is provided a doorknob alarm device comprising a body designed to be mounted on or near a doorknob, electronic circuit means within said body including, an oscillator signal source having an output at which a self-initiating and self-compensating oscillatory signal appears, an oscillatory signal detection circuit having a low gain for slow signal level fluctuations and a high gain for rapid signal level fluctuations and having no manual sensitivity adjustment, said detection circuit having an input and an output, a circuit network interconnecting said oscillatory signal source output and said detection circuit input and having a conductive path extending therefrom that can be placed in conductive contact with a doorknob on or near to which said body is mounted, and alarm generating means having a signal input connected to the output of said detection circuit for generating an alarm in response to a substantial change in the magnitude of the output of said detection circuit.

Still further according to the invention there is provided a doorknob alarm device comprising a body having an electronic circuit therein including an oscillatory signal source, an oscillatory signal change detection circuit, a circuit network interconnecting said oscillatory signal source and said detection circuit, a conductive path from said circuit network to a doorknob, alarm generating means coupled to an output of said said signal change detection circuit for generating an alarm in response to a substantial change in the magnitude of the output of said detection circuit, and a coiled metallic spring connected at each end of said body and forming a loop adapted to be received over a doorknob, said spring being electrically coupled to said circuit network to form said conductive path and resiliently clamping said body to the shank of the doorknob thereby, not only to provide good electrical coupling between the doorknob and said circuit network, but also to mechanically hold said device in place on the doorknob.

Basically, the oscillation circuit generates an oscillatory signal and supplies it through the coupling network to the signal level detecting circuit. The coupling network contains a capacitive path that includes the doorknob and any human who may be grasping the doorknob. Therefore, when someone places their hand upon the doorknob, the added capacity bypasses a small part of the oscillatory signal that reaches the signal level detecting circuit. The detection circuit includes a differential amplifier that has a very low gain for rising or slowly falling signal levels but an extremely high gain for suddenly falling signal levels.

When the detection circuit is first energized, the pulse signal rises from a low level to its normal high level, and the pulse train flowing into the high gain differential amplifier at a non-inverted input rises quickly to a high level. A diode in the output of the amplifier is conductive at this time and quickly charges a large capacitor in the differential amplifier. The amplifier output is also directly coupled to the inverting input, so the amplifier functions as a unity gain device which generates a moderately high output corresponding to the amplitude of the incoming pulses. Assuming no human hand touches the doorknob, the device then remains stable with its output at a medium-to-high level. If someone's hand touches the doorknob and thereby reduces the amplitude of the pulse train, the peak of the input pulses applied to the non-inverting amplifier input suddenly falls.

The detection circuit includes circuitry for measuring and recording the peak amplitude of the oscillating signal flowing from the coupling network, and separate circuitry for measuring and recording the actual amplitude of the oscillating signal at any given moment. The detection circuit also includes comparison circuitry connected between the measuring and recording circuitry for indicating when the actual oscillating signal amplitude falls below its peak amplitude as when the actual signal amplitude is reduced due to the bypassing effect of the capacity of someone's hand having been placed upon the doorknob. Preferably, the comparison circuitry has sufficient gain to give an indication even if the drop in the level of the oscillating signal is small.

Many possible circuit configurations can achieve the above result. In the preferred embodiment of the invention, the measuring and recording circuitry and the comparison circuitry are integrated in such a way that a single differential amplifier is used to charge up first and second capacitors to the peak and actual levels of the oscillating signal, and that same amplifier is also used to compare the peak and actual signal levels.

The differential amplifier has non-inverted and inverted input terminals, a high-impedance output terminal, and relatively high open-loop gain. The first capacitor connects the output terminal of this amplifier to ground. The second, larger capacitor is connected from the inverted input terminal to ground, and a diode connects the amplifier output terminal to its inverted input terminal. The oscillating signal, a series of positive-going pulses, is fed from the coupling network to the non-inverted input terminal. Briefly, the diode coupling the amplifier output to its inverted input is oriented to produce unity gain for positive input fluctuations. The high-impedance output terminal and the first capacitor function as a first rectifier and store upon the first capacitor a steady potential whose magnitude corresponds to the actual peak amplitude of the oscillating signal. The second capacitor is also charged to close to actual peak amplitude, but its larger size causes it to remain charged to the peak signal level while the smaller size of the first capacitor permits it to discharge rapidly and follow the actual level of the oscillating signal when the signal falls in amplitude. Accordingly, the differential amplifier output potential rises as the oscillating signal level rises to its normal level. When the oscillating signal level falls even slightly, the differential amplifier output fall sharply negative. Since the negative feedback through the diode is cut off, the amplifier strongly amplifies a small drop in the level of the oscillating signal and produces an output signal pulse of sufficient amplitude to trigger an alarm mechanism. Accordingly, the circuit is insensitive to ambient conditions and to the quiescent amplitude or frequency of the oscillatory signal, but is responds quickly and positively to even a small drop in the level of the signal.

DESCRIPTION OF THE PREFERRED EMBODIMENT

Figure 1:
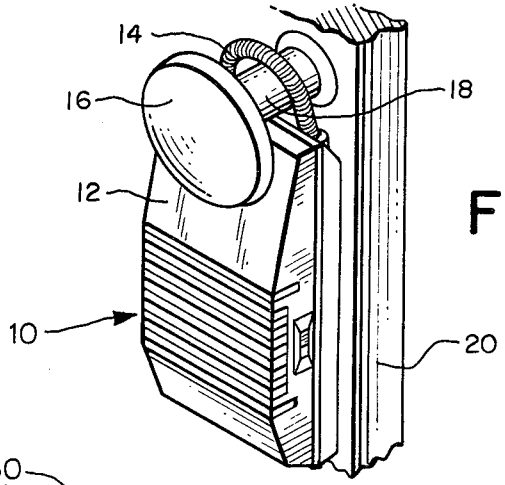
FIG. 1 is a perspective view of the doorknob alarm device of the present invention attached to a doorknob.

Referring now to FIG. 1 there is illustrated therein a doorknob alarm device 10 which is constructed according to the teachings of the present invention. As shown, the device 10 includes a body 12 with a metallic spring strap 14 fixed thereto and designed to be slipped over a doorknob 16 and resiliently held against a shank portion 18 of the doorknob 12. The spring strap 14 provides a relatively tight resilient holding of the device 10 to the doorknob 16 to prevent flopping of the device 10 against a door 20 on which the doorknob 16 is mounted, while at the same providing a good electrical connection between the spring strap 14 and the doorknob 12.

Figure 2:
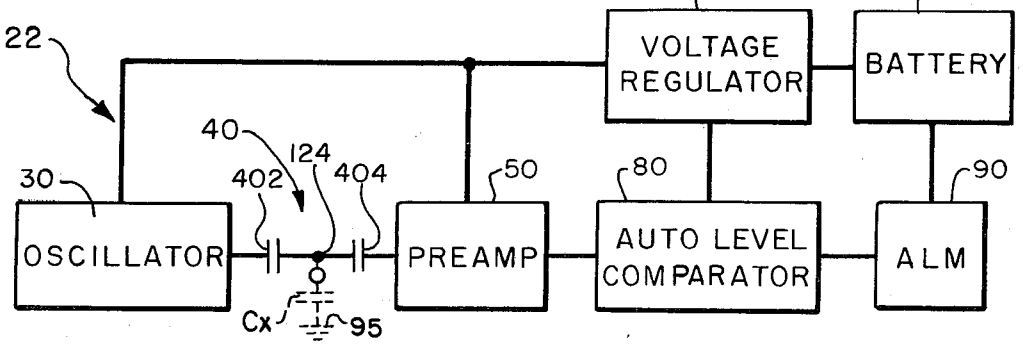
FIG. 2 is a block diagram of the electrical circuit of the doorknob alarm device shown in FIG. 1.

Referring now to FIG. 2 there is illustrated therein a block circuit diagram of an electrical circuit 22 of the device 10. The circuit 22 includes an oscillator circuit 30 coupled by a capacitance coupling network 40 to a preamplifier circuit 50 which in turn is driven by a voltage regulator circuit 60 that is energized by a battery 70 with the output of the preamplifier circuit 50 being fed to an auto level comparator circuit 80 which operates an alarm circuit 90.

When the device 10 is hung on a doorknob and the power is switched on, the auto level comparator circuit 80 will set up a voltage level in about 15 seconds due to an environmental capacitance $C_x$ which is the capacitance between the doorknob 16 and ground 95. If someone touches the doorknob 16, the capacitance of $C_x$ will increase. This causes pulses from the oscillator circuit 30 through the capacitance network 40 to be attenuated. Such attenuated pulse amplified by the preamplifier circuit 50 will then be compared by the auto level comparator circuit 80 which will differentiate the change in amplitude of the pulse and output a logic signal to the alarm circuit 90 which then puts out an intermittent alarm, as will be described in greater detail hereinafter in connection with the description of FIG. 3.

Figure 3:
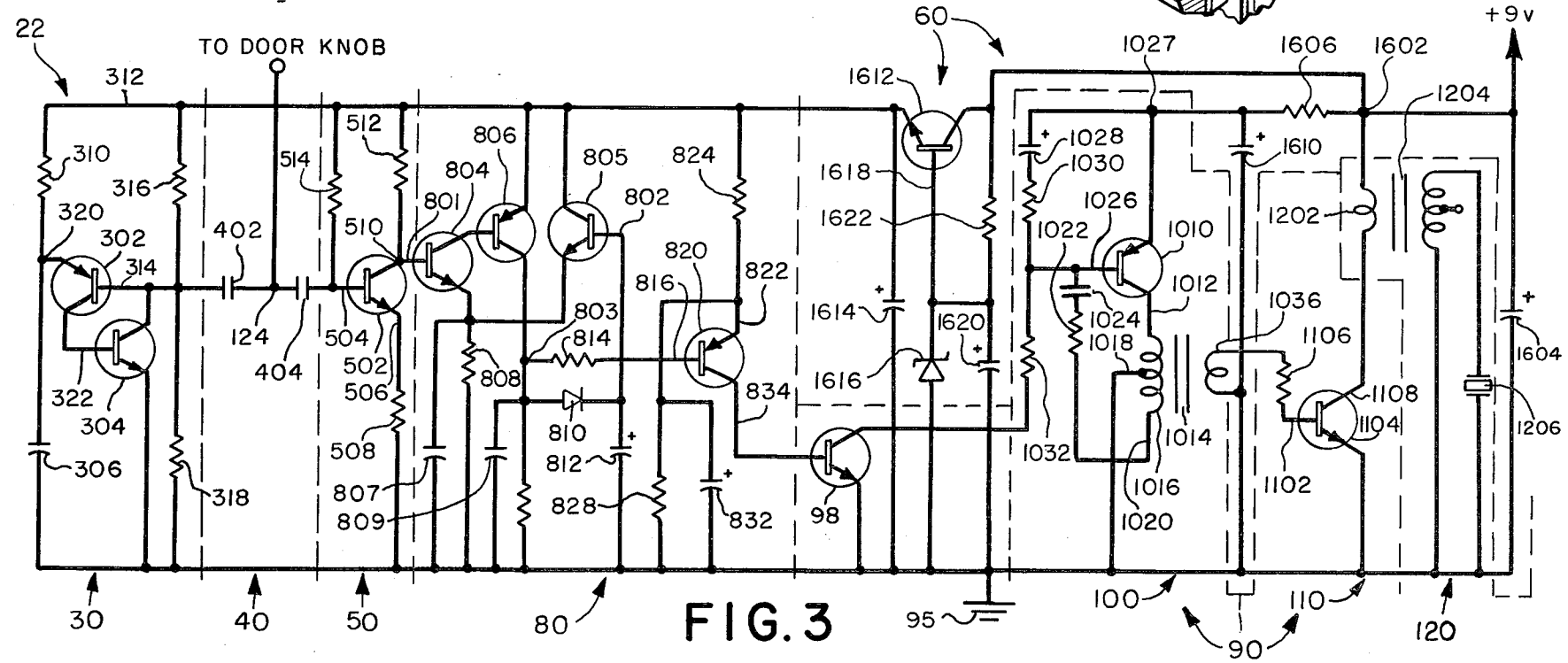
FIG. 3 is a detailed schematic diagram of the electrical circuit shown in FIG. 2.

The electrical circuit 22 is shown in greater detail in FIG. 3. As shown, the oscillator circuit 30 is a relaxation oscillator which is coupled through the capacitance coupling network 40 to the preamplifier circuit 50. The output from the preamplifier circuit 50 is applied to the auto level comparator circuit 80, which is basically a detection circuit, and the output from the detection circuit is applied to an alarm amplifier 98 of the alarm circuit 90 which also includes a pulsed tone generator 100, output amplifier circuit 110, and a transducer/buzzer circuit 120.

The electrical circuit 22 functions generally by having the relaxation oscillator 30 generate a continuous stream of pulses which pass through the capacitance coupling network 40 and are amplified by the amplifier 50. These pulses which are received by the detection circuit 80 produce a positive level output from the detection circuit 80, as will be explained hereinafter. A connection from a middle node 124 of the capacitive coupling network 40 to the doorknob 16 makes it possible for the added capacity $C_x$ introduced when one grasps the doorknob to reduce the amplitude of the pulse signal that reaches the amplifier 50 and is applied to the detection circuit 80. The detection circuit 80 responds by producing a negative level output that is amplified by the amplidier 98 and used to energize the pulsed tone generator 100 the output of which is further amplified by the amplifier circuit 110 and applied to the transducer/buzzer circuit 120.

The relaxation oscillator 30 is formed from two transistors 302 and 304 of opposite polarity type interconnected into a bistable configuration with the collector of each connected to the base of the other. The emitters of the two transistors 302 and 304 are connected in parallel across a capacitor 306 one end of which is connected to ground 95 and the other end of which is coupled by a resistor 310 to a bus 312 connected to regulated potential source 60. A base lead 314 of the transistor 302 is connected to a voltage divider formed by resistors 316 and 318 that extend respectively from the base 314 to the positive source of potential 312 and to ground 95. In this manner, the base of the transistor 302 is normally clamped at an intermediate potential level. In a preferred embodiment, the resistor 316 is 27,000 ohms and the resistor 318 is 120,000 ohms.

When the oscillator circuit 30 is first energized, the capacitor 306 is fully discharged, and the biasing on the transistors 302 and 304 is such that both are non-conductive. Current immediately begins flowing through the resistor 310 into the capacitor 306, and this current charges the capacitor 306 until the potential at a node 320 (the emitter of the transistor 302) rises above the potential at the base 314 of the transistor 302. The transistor 302 then becomes conductive and passes a current into the base 322 of the transistor 304. This base current causes the transistor 304 to connect the base 314 directly to ground 95. Because the transistor 302 is fully conductive, a discharge path for the capcitor 306 is created from the node 320, through the emitter-base junction of the transistor 302 to the base 314 and through the collector-emitter leads of the transistor 304 to ground 95 and back to the capacitor 306. The capacitor 306 is thus rapidly discharged. Finally, when the voltage across the capacitor 306 is almost zero, current flowing through the resistor 316 is sufficient to raise the potential of the base 314 of the transistor 302 positive of the potential of the node 320. The transistor 302 then ceases to conduct and the entire circuit returns to its initial state with the capacitor 306 commencing once again to charge. Accordingly, the entire circuit functions as a relaxation oscillator with the capacitor 306 being alternately discharged to almost zero potential and then charging through the resistor 310 until its potential is slightly above the potential of the node 314, the potential of which is established by the relative values of the resistors 316 and 318. The time between these oscillations is determined by the value of the capacitor 306 and the resistor 310. In a preferred embodiment of the invention, resistor 310 has a value of 7.5 million ohms and the capacitor 306 has a capacitance value of 50 picofarads. The negative-going pulses generated by this oscillator circuit 30 appear at the base 314 and are applied directly to the capacitance coupling network 40.

The capacitance coupling network 40 comprises two capacitors 402 (15 picofarads) and 404 (10 picofarads) connected serially between the base 314 at the output of the relaxation oscillator circuit 30 and an input to the preamplifier circuit 50. In addition, the node 124 common to the capacitors 402 and 404 is connected by means of a conductive path to the doorknob 16. The ground node 95 is also connected to a metal plate (not shown) mounted adjacent the door, and accordingly an electric field is set up in the space between the doorknob and the ground lead 95 whenever the relaxation oscillator 30 delivers a pulse. When someone's hand is placed upon the doorknob 16, the capacitance between the node 124 and ground 95 is increased, and that capacitance and the capacitor 402 form a voltage divider that reduces the potential of the pulses appearing at the node 124.

The voltage preamplifier circuit 50 comprises a single transistor 502 having its base 504 forming the input to the preamplifier circuit and its emitter 506 connected to ground through a 7500 ohm resistor 508. A collector 510 of the transistor 502 is connected by means of a 120,000 ohm resistor 512 to the bus 312. The base 504 of the transistor 502 is connected by means of a 3.3 million ohm resistor 514 to the bus 312. Sufficient current flows through the resistor 514 to bias the trasistor 502 into its proper operating range so that amplified inverted pulses appear at the collector 510.

The effective input impedance of the transistor 502 is roughly 100–300 times the resistance of the resistor 508 or 100,000 to 300,000 ohms. The pulse signal applied to the base 504 appears at the same voltage level but at a much lower impedance level at the emitter 506. Since the emitter and collector current of the transistor 502 are equal, this same pulse signal also appears at the collector 510 amplified in voltage by a factor equal to the ratio of the collector resistor 512 to the emitter resistor 508. Accordingly, the gain of the amplifier 50 voltage-wise is roughly 16. Also, the pulses at the collector 510 are inverted such that the pulses are positive-going pulses.

The output pulses at the collector 510 of the amplifier 50 are applied to a non-inverting input 801 of the detection circuit 80. An inverting input to this detection circuit 80 is at conductor 802, and an output appears at a node 803.

The detection circuit 80 includes a pair of transistors 804 and 805 connected in a common-emitter configuration such that the difference between the potential at the non-inverting input 801 and at the inverting input 802 appears as a current flowing from the collector of the transistor 804 into the base of a transistor 806 which further amplifies this current and sends it out the collector of the transistor 806 to the output node 803. The emitters of the transistors 804 and 805 are connected through a parallel RC network comprising a 0.04 microfarad capacitor 807 and a 1 million ohm resistor 808 to ground 95.

The current that flows from the transistor 806 is flowing from the collector of a transistor which inherently has a very high output impedance and is, effectively, a current output from an ideal current source. Accordingly, a 0.04 microfarad capacitor 809 that connects the node 803 to ground 95 is charged to the peak level of the incoming pulses. The capacitor 809 and the transistor 806 effectively rectify (or more accurately, peak detect) the pulse signals such that a potential proportional to the actual peak amplitude of the pulses appears at the node 803. Accordingly, the potential at the node 803 indicates the actual amplitude of the pulses flowing from the amplifier 50.

A diode 810 connects the output node 803 back to inverting input 802 of the detection circuit 80. The inverting input 802 is also coupled to the ground node 95 by a large 100 microfarad capacitor 812. By feeding the detection circuit output back to its inverting input 802 for all positive going pulses, the diode 810 effectively reduces the gain of the detection circuit 80 to unity for the positive pulses that appear at the input 801. Accordingly, the potential at the node 803 and also at the inverting input 802 quickly rise to a positive level equal to the peak positive swings of the pulses applied to the input 801. The large size of the capacitor 812 causes it to remain charged to the peak level of the incoming pulse signal even after the peak level drops due to the presence of a hand upon the doorknob 16.

It is noteworthy that the positive level at the output 803, due to the unity gain of the detection circuit 80, never swings to an extreme positive level but always remains at a moderate level. The potential at 803 is applied through a 10 million ohm resistor 814 to the base 816 of a transistor 820 having its emitter 822 connected to a potential divider formed by a 39,000 ohm resistor 824 and a 56,000 ohm resistor 828 that extend from emitter 822 respectively to the positive potential bus 312 and to ground 95. The resistor 828 is bypassed by a capacitor 832 having a capacitance value of 50 microfarads. Accordingly, the transistor 820 functions as a switch that detects when the voltage at the output 803 of the detection circuit 80 falls below the potential of the emitter 822 whose potential is relatively fixed.

When the alarm circuit is in its quiescent state, the pulses appearing at the input 801 to the detection circuit 80 are large enough to raise the potential of the output 803 to a level above the potential at the node 822, thereby rendering the transistor 820 non-conductive. No current flows from a collector lead 834 of the transistor 820 into the base of a transistor amplifier 98 forming a tone generator switch. Accordingly, the transistor 98 disables the tone generator circuit 100 and prevents any alarm signal from being given off.

When the device 10 is first turned on, the potential at the node 803 rises faster than does the potential of the emitter 822 due to the need to charge the capacitor 832. Accordingly, no alarm is given off when the device is first turned on.

The low current drain of the detection circuit 80 just described is noteworthy. In its quiescent state, the transistors 822 and 98 are both biased into non-conduction. The transistors 302 and 304 only conduct momentarily to discharge the capacitor 306, and that capacitor is charged through the high-valued resistor 310. The transistor 502 is normally conductive, but it has a very large collector resistor 512 that drastically limits the amount of current it can draw. The input 801 normally is negative and keeps transistors 804 and 806 non-conductive. Accordingly, the circuits draw only a trickle of current in their quiescent state and will not rapidly deplete the battery power supply 70.

When someone places their hand upon the doorknob 16, the peak magnitude of the pulses appearing at the input 801 to the detection circuit 80 drops slightly negative. The positive level pulses no longer maintain the charge on capacitors 809 and 812. Because the diode 810 no longer conducts, and because there is no other discharge path for the capacitor 812, the inverted input node 802 remains clamped at the peak positive pulse level established by the former peak amplitude of the positive-going pulses that is stored within the capacitor 812. The capacitor 809 now rapidly discharges, since the positive pulses are no longer rendering the transistors 804 and 806 conductive. Accordingly, the potential of the node 803 rapidly drops toward ground level until the transistor 822 becomes fully conductive. Current flowing from the transistor 822 renders the tone transistor switch 98 fully conductive, and that switch in turn energizes the tone generating circuitry, as will be explained in detail below. It is noteworthy that regardless of the initial amplitude of the pulses and regardless of the pulse signal frequency, the differential amplifier in the detection circuit 80 compensates by adjusting the charge on the capacitors 812 and 809. These capacitors are both initially charged to the peak value of the pulse signal appearing at 801, whatever that peak value may happen to be. Because the potential at the input 801 is developed across a resistor 512 extending from the positive bus 312 downwards, the potential level established on the capacitors 809 and 812 is always considerably higher than the quiescent voltage at the node 822, and the transistor 820 is always set initially to a non-conductive state. The automatic self-adjusting of the potential levels across the capacitors 809 and 812 thus compensates for any misadjustment or change in tolerance of the circuit components and also compensates for any difference in the configuration of the door with respect to its capacity to ground.

Regardless of the frequency of oscillation, the magnitude of the oscillation, or the capacity of the door, when the amplitude of the pulse train is decreased through the addition of capacity from the hand of an intruder, immediately the two transistors 804 and 806 are rendered non-conductive, and the potential of the node 803 falls toward ground. In effect, the negative feedback path through the diode 810 is cut off when the signal level drops so that the detection circuit 80 becomes an extremely high gain amplifier measuring the difference between the peak signal pulse level, as recorded in the capacitor 812 and applied to the inverting input 802, and the actual amplitude at the non-inverting input 801, presenting the difference between these two signal levels at the output 803. The circuit 80 is extremely stable and requires no adjustments, yet it is able to respond rapidly to even a small increase in the capacity of the capacitance $C_x$ between the doorknob 16 and ground 95.

The pulsed tone generator 100 comprises a transistor 1010 having its collector 1012 connected to one side of a transformer 1014 primarly winding 1016. The winding 1016 has a center-tap lead 1018 descending to ground 95. An end 1020 of the primary winding 1016 is fed back through a resistor 1022 and a capacitor 1024 to the base 1026 of the transistor 1010. The base 1026 is also connected to a positive-potential node 1027 by a series circuit comprising a capacitor 1028 and a resistor 1030 and is connected to ground through a resistor 1032 and the tone switch transistor 98.

When the pulsed tone generator circuit 100 is in its quiescent state, the transistor 98 is non-conductive, and no tone flows from the transformer 1014. When the capacitance $C_x$ from the doorknob 16 to ground 95 is increased, the transistor 98 immediately becomes fully conductive and connects the resistor 1032 to ground 95. Current flowing through the resistor 1032 then charges the capacitor 1028 until finally the base 1026 of the transistor 1010 is biased far enough negative to render the transistor 1010 partially conductive. At this point, an output current at the collector 1012 flowing from the transistor 1010 develops a potential across the coil 1016. An inverted potential at 1020 is fed through the network comprising the resistor 1022 and the capacitor 1024 back to the base 1026 of the transistor 1010. The entire circuit thus forms a blocking oscillator in which the transistor 1010 is rendered alternately conductive and non-conductive by the feedback flowing through the resistor 1022 and the capacitor 1024.

Oscillations continue with current flowing out of the capacitor 1028, through the resistor 1030, and into the base 1026, until the capacitor 1028 is discharged to the point where oscillations can no longer be maintained due to the positive bias on the base 1026. At this point, the oscillator switches itself off and returns to its quiescent state until the current flowing through the resistor 1032 can once again charge the capacitor 1028 up to a level that starts the oscillations again. Accordingly, the entire circuit 100 alternates between a state of oscillation and a state of quiescence, thereby producing tone bursts that are developed in the primary of the transformer 1014.

A secondary winding 1036 of the transformer 1014 connects between ground 95 and the base 1102 of a transistor 1104 through a resistor 1106 in the amplifier circuit 110. The emitter of the transistor 1104 is grounded, and its collector 1108 is connected to the +9 v source through a primary winding 1202 of an output transformer 1204 that drives a ceramic buzzer 1206 in the transducer/buzzer circuit 120. Accordingly, the oscillatory output of the transformer 1014 is amplified and applied to the buzzer 1206. In this way, when an intruder places his hand upon the doorknob 16, bursts of tone are applied to the transducer/buzzer circuit 120.

In addition to the circuits described, other conventional power supply and circuit components are disclosed. Nine volts, assumedly derived from a small battery, is applied between a positive node 1602 of the voltage regulator circuit 60 and ground 95. A large electrolytic capacitor 1604 filters this input potential and maintains a stable potential for operation of the output amplifier. An isolation resistor 1606 connects the positive potential node 1602 to the positive supply node 1027 having a filtering capacitor 1610. The node 1027 supplies all the necessary power for the tone generator 100. Current from the node 1602 is also applied to a transistor 1612 of the voltage regulator circuit 60 havings its collector connected to the node 1602 and its emitter connected to the positive bus 312 that powers all of the sensing circuitry. A capacitor 1614 suppresses ripples at the positive potential bus 312. To provide for voltage regulation, a backbiased Zener diode 1616 connects the base 1618 of the transistor 1612 to ground and is bypassed by a capacitor 1620. The base 1618 is also connected to the node 1602 by means of a resistor 1622 that provides a sustaining current for the Zener diode 1616. Alternative power supply arrangements could be provided without disturbing the operation of the circuit 22.

While a preferred embodiment of the invention has been described, it will be understood by those skilled in the art that numerous modifications and changes can be made to the device without departing from the teachings of the invention as claimed in the appended claims.

We claim:

1. A doorknob alarm device comprising a body, means for hanging said device from a doorknob, electronic circuit means within said body including an oscillator circuit, a capacitance network coupled to the output of said oscillator circuit, an amplifier circuit coupled to the output of said capacitance network, means for electrically coupling said capacitance network to the doorknob so as to form an input to said electronic circuit means, self-initializing and self-compensating, oscillatory signal level detecting circuit means without manual sensitivity adjustment coupled to the output of said amplifier for detecting drops in the signal level from said amplifier such as would be caused by the addition of capacitance to said capacitance network when someone's hand comes close to or touches the doorknob on which said device is hung, an alarm circuit coupled to the output of said signal level detecting circuit, said alarm circuit being triggered by said signal level detecting circuit and a regulated D.C. power supply for supplying voltage to said electronic circuit means.

2. The device according to claim 1 wherein said oscillator circuit is a relaxation oscillator.

3. The device according to claim 1 wherein said capacitance network includes two series connected capacitors coupled between said oscillator circuit and said amplifier circuit with said electrical coupling means being connected to a node between said capacitors.

4. The device according to claim 1 wherein said signal level detecting circuit means includes a differential amplifier.

5. The device according to claim 4 wherein said differential amplifier includes means for measuring and storing the peak amplitude of the oscillating signal flowing through said capacitance network, means for measuring and storing the actual amplitude of the oscillating signal at any given moment and means for comparing the signal levels stored in said respective measuring and storing means and for producing an output signal when there is a drop in the level of the oscillating signal.

6. The device according to claim 4 wherein said differential amplifier includes first and second common emitter connected transistors, the base of said first transistor comprising a non-inverting input to said differential amplifier and the base of said second transistor comprising an inverting input to said differential amplifier with the difference between the inputs appearing as an output current flowing from the collector of said first transistor.

7. The device according to claim 6 wherein said differential amplifier further includes a first capacitor which forms said means for storing the peak amplitude and which is connected between said collector of said first transistor and system ground for said electronic circuit means, said first capacitor being charged to the peak level of the incoming pulse, a diode connected between said collector of the first transistor and said base of said second transistor and a second large capacitor which forms said means for storing the actual amplitude and which is connected between said base of said second transistor and system ground.

8. The device according to claim 1 wherein said alarm circuit includes an alarm amplifier coupled to the output of said signal level detecting circuit, a pulsed tone generator coupled to the output of said alarm amplifier, a second amplifier circuit coupled to the output of said pulsed tone generator and a transducer/buzzer circuit coupled to the output of said second amplifier circuit.

9. The device according to claim 8 wherein said pulsed tone generator includes a blocking oscillator.

10. The device according to claim 9 wherein said blocking oscillator includes a transistor having its base coupled to the output of said alarm amplifier, its emitter coupled to said power supply, a primary winding of a transformer coupled between the collector of said transistor and system ground, a first series RC circuit coupled between said emitter and said base and a second series RC circuit coupled between said base and a tap in said primary winding, the secondary winding of said transformer being coupled to said second amplifier circuit.

11. The device according to claim 1 wherein said means for hanging said device from a doorknob includes a strap secured to said body and said means for electrically coupling said capacitance network to the doorknob comprises electrically conductive means on said strap for contacting the doorknob, said electrically conductive means being coupled by a conductor to said capacitance network.

12. The device according to claim 11 wherein said strap is a coiled metallic spring which resiliently clamps said device to the shank of a doorknob not only to provide a good electrical coupling between the doorknob and said capacitance network but also to mechanically hold said device in place on the doorknob.

13. A doorknob alarm device according to claim 1 wherein said hanging means include a loop, wherein said coupling means include means on said loop for electrically coupling the doorknob to said electronic circuit and wherein said device includes means for resiliently urging said loop and said coupling means against the shank of the doorknob.

14. A doorknob alarm device comprising a body designed to be mounted on or near a doorknob, electronic circuit means within said body including, an oscillatory signal source having a self initiating and self-compensating output at which an oscillatory signal appears, an oscillatory signal detection circuit having a low gain for slow signal level fluctuations and a high gain for rapid signal level fluctuations and having no manual sensitivity adjustment, said detection circuit having an input and an output, a circuit network interconnecting said oscillatory signal source output and said detection circuit input and having a conductive path extending therefrom that can be placed in conductive contact with a doorknob on or near to which said body is mounted, and alarm generating means having a signal input connected to the output of said detection circuit for generating an alarm in response to a substantial change in the magnitude of the output of said detection circuit.

15. The doorknob alarm device according to claim 14 wherein said detection circuit also has a low gain for rising signal level fluctuations.

16. The doorknob alarm device according to claim 14 wherein said detection circuit includes a differential amplifier comprising means for measuring and storing the peak amplitude of the oscillatory signal flowing through said circuit network, means for measuring and storing the actual amplitude of the oscillatory signal at any given moment, and means for comparing the signal levels stored in said respective measuring and storing means and for producing an output signal when there is a drop in the level of the incoming oscillatory signal.

17. The doorknob alarm device according to claim 14 including a coiled metallic spring fixed at each end to said body and electrically coupled to said circuit network, said spring being resiliently received over and clamped against the shank of a doorknob, not only to provide a good electrical coupling between the doorknob and said circuit network to form said conductive path but also to mechanically hold said device in place on the doorknob.

18. A doorknob alarm device comprising a body having an electronic circuit therein including an oscillatory signal source, an oscillatory signal change detection circuit, a circuit network interconnecting said oscillatory signal source and said detection circuit, a conductive path from said circuit network to a doorknob, alarm generating means coupled to an output of said signal change detection circuit for generating an alarm in response to a substantial change in the mangitude of the output of said detection circuit, and a coiled metallic spring connected at each end to said body and forming a loop adapted to be received over a doorknob, said spring being electrically coupled to said circuit network to form said conductive path and resiliently clamping said body to the shank of the doorknob thereby, not only to provide good electrical coupling between the doorknob and said circuit network, but also to mechanically hold said device in place on the doorknob.

19. In a doorknob alarm device of the type wherein a change in signal level in an electronic circuit within the device is generated as a result of a person coming near to or touching a doorknob to which the device is electrically coupled, the change in signal level being utilized to generate an alarm, the improvement comprising self-initializing and self-compensating signal level detecting means which do not have any manual sensitivity adjustment and which have low gain for a slowly changing signal level and a high gain for a rapidly changing signal level.

* * * * *